United States Patent [19]

Hori

[11] Patent Number: 4,511,238

[45] Date of Patent: Apr. 16, 1985

[54] TRAVERSING, INTERMITTENTLY CONTACTING SHEET PICKOFF FOR ELECTROPHOTOGRAPHIC COPIER

[75] Inventor: Tatsu Hori, Los Altos, Calif.

[73] Assignee: Savin Corporation, Stamford, Conn.

[21] Appl. No.: 513,359

[22] Filed: Jul. 13, 1983

[51] Int. Cl.[3] ..... G03G 15/00

[52] U.S. Cl. ..... 355/3 SH

[58] Field of Search ..... 355/3 SH, 14 SH, 3 R, 355/14 R; 271/DIG. 2, 174, 311

[56] References Cited

U.S. PATENT DOCUMENTS

| | | | |
|---|---|---|---|
| 3,885,786 | 5/1975 | Schmalzbauer | 271/174 |
| 3,992,000 | 11/1976 | Martin | 271/174 |
| 4,342,043 | 7/1982 | Palermiti et al. | 355/14 SH X |
| 4,363,550 | 12/1982 | Toshimitsu et al. | 355/14 SH X |
| 4,387,981 | 6/1983 | Cormier | 355/3 SH |
| 4,420,243 | 12/1983 | Baker et al. | 355/3 SH X |

*Primary Examiner*—A. C. Prescott

*Attorney, Agent, or Firm*—Shenier & O'Connor

[57] ABSTRACT

A pickoff element for separating a carrier sheet from the photoconductor drum of a liquid-developer electrophotographic copier following transfer of a developed toner image to the sheet is incrementally moved transversely of the direction of movement of the photoconductor to distribute wear over a relatively large portion of the photoconductor surface. Upon its return to home position, a copier scanner casting strikes an actuator arm coupled through a one-way clutch to a double-helix lead screw, extending parallel to the drum axis, to impart incremental unidirectional rotation to the lead screw. A follower engaging the lead screw is coupled to the pickoff element to shift the pickoff element transversely in response to the rotation of the lead screw. The pickoff element is normally retracted from the photoconductor, and is only moved into engagement with the photoconductor during selected portions of the copy cycle to minimize drum wear, as well as to avoid pickup of toner particles that have been attracted onto a non-image portion of the photoconductor from the development electrode during a cleaning stage of the copy cycle.

8 Claims, 13 Drawing Figures

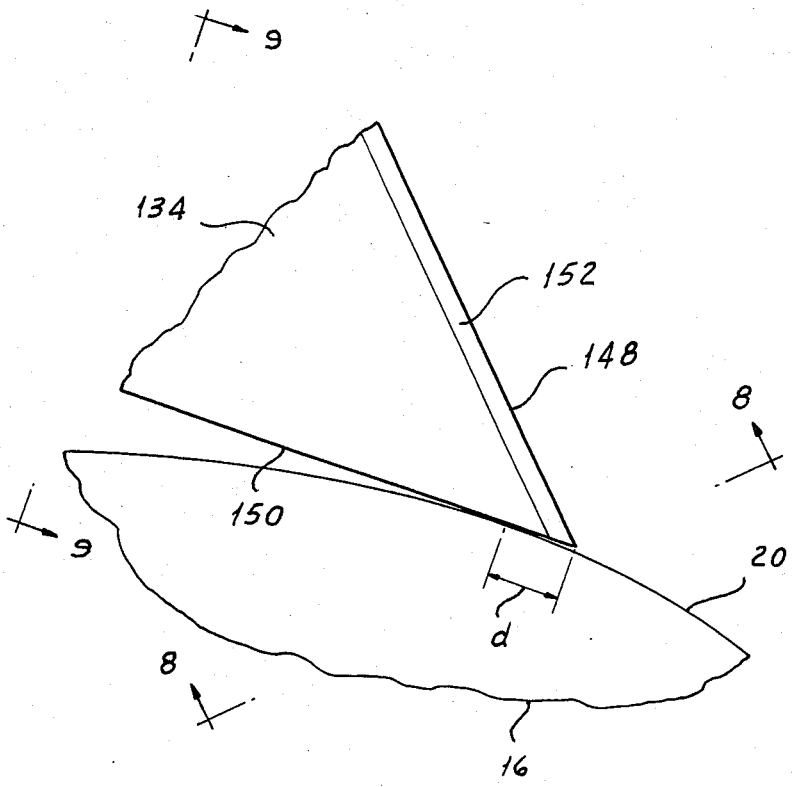
FIG 7
FIG 8
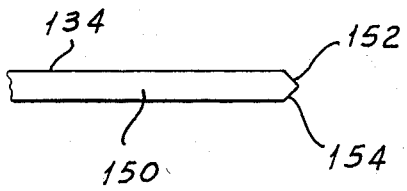
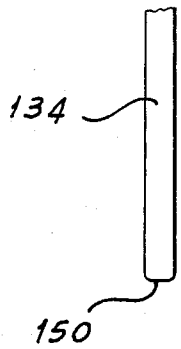
FIG 9

TRAVERSING, INTERMITTENTLY CONTACTING SHEET PICKOFF FOR ELECTROPHOTOGRAPHIC COPIER

FIELD OF THE INVENTION

This invention relates to apparatus for separating a copy sheet from a moving photoconductive imaging surface of an electrophotographic copier following transfer of a developed image to the sheet and, more particularly, to such apparatus for use in a liquid-developer copier having a development electrode and moving scanning optics.

BACKGROUND OF THE INVENTION

Devices for separating a copy sheet from a moving photoconductive imaging surface of an electrophotographic copier following transfer of a developed image to the sheet, variously referred to as pickoffs or strippers, are well known in the art. Thus, one type of pickoff known in the art uses a mechanical element such as a blade which rides on the imaging surface to intercept the leading edge of a copy sheet as it moves past the element. One of the advantages of a pickoff of this type is that it allows intimate contact between the entire width of the copy sheet and the imaging surface in the transfer station. However, if such a pickoff is allowed to ride continuously on the photoconductive imaging surface, it will eventually abrade the photoconductive surface, thus reducing its useful life.

Moreover, if a contacting pickoff blade is maintained at the same position along the width of the photoconductor, and is electrically grounded to prevent charge buildup, it will adversely affect the photoconductor electrically along the line of contact resulting in light gray voids on copies. This effect is believed to occur because the blade discharges the contacted portion of the photoconductor, bringing its electrical potential well below that of adjacent surface portions, which retain a residual of their original charge. This charge differential remains to a substantial degree even when the surface is subsequently charged in preparation for another copy cycle. As a result, the visible image along the line of contact with the pickoff blade, which is determined by the electrical charge, is noticeably less black than the image on adjacent areas.

It is known in the art to move a contacting mechanical pickoff element transversely of the imaging surface so as to minimize the wear of any one longitudinal surface portion contacted by the element. Thus, Kono et al U.S. Pat. No. 4,252,310 and Golz et al U.S. Pat. No. 4,168,902 discloses various systems for shifting a pickoff element transversely of the direction of movement of a photoconductor to alter the point of engagement. However, since these systems only move the pickoff over a small portion of the width of the photoconductor, the wear along the contacted portion remains relatively high. In addition, the systems for imparting a translatory motion to the pickoff element are relatively complicated.

It is also known in the art, as shown in the Kono et al patent referred to above, to lift the pickoff element from the photoconductor during certain portions of the copy cycle to minimize the total contact time. However, if pickoff retraction is timed only with regard to the passage of the sheet, there remains the possibility that the pickoff will accumulate heavy toner deposits, especially in a liquid-developer copier having a development electrode which is periodically cleaned by electrically attracting toner material from the electrode onto a non-image portion of the photoconductor.

SUMMARY OF THE INVENTION

In one aspect, my invention contemplates apparatus in which a pickoff element adapted to be positioned in engagement with the photoconductor of an electrophotographic copier is shifted transversely of the photoconductor in response to a movable optical scanning element, preferably in response to movement of a reciprocating scanning element to a predetermined position. Preferably the shifting means comprises a reciprocating member coupled to the pickoff element and a threaded member, such as a lead screw, which engages the reciprocating member and is coupled through a one-way clutch to a sensing element positioned in the path of movement of the scanning element.

In another aspect, my invention contemplates apparatus in which a pickoff element adapted to be positioned in engagement with a photoconductor is coupled to a reciprocating member engaging a threaded member which is rotated to reciprocate the pickoff element. Preferably, the threaded member comprises a double-helix lead screw supported for rotation around an axis extending transversely of the photoconductor, while the lead screw rotation is preferably derived through a one-way clutch from a reciprocating motion source such as the scanning element referred to above.

In yet another aspect, my invention contemplates a pickoff assembly for use in a liquid-developer copier in which toner material is electrostatically attracted from a development electrode to a non-image portion of the photoconductor during selected portions of the copy cycle to maintain the development electrode free of accumulated toner. To prevent pickup of such toner material by the pickoff, the pickoff element is retracted from the photoconductor concurrently with the movement past the pickoff element of the non-image photoconductor portion onto which toner particles have been deposited.

OBJECTS OF THE INVENTION

One of the objects of my invention is to provide a sheet pickoff for an electrophotographic copier which allows the transfer of a developed image to the entire area of a copy sheet.

Another object of my invention is to provide a sheet pickoff which is reliable.

Still another object of my invention is to provide a sheet pickoff which does not result in excessive wear of an imaging surface.

A further object of my invention is to provide a sheet pickoff which is able to operate a relatively long period of time without requiring adjustment or replacement of parts.

A still further object of my invention is to provide a sheet pickoff which does not leave toner deposits on the image sides of copy sheets.

Another object of my invention is to provide a pickoff which does not permit the buildup of triboelectric charges on the drum.

A further object of my invention is to provide a sheet pickoff which is usable with imaging drums of various diameters.

Still another object of my invention is to provide a sheet pickoff which does not accumulate excessive toner deposits from an imaging surface.

Other and further objects will be apparent from the following description.

BRIEF DESCRIPTION OF THE DRAWINGS

In the accompanying drawings, which form part of the instant specification and which are to be read in conjunction therewith, and in which like reference numerals are used to indicate like parts in the various views:

FIG. 3 is an enlarged fragmentary view of the sheet pickoff of the copier shown in FIG. 1, along line 3—3 of FIG. 2.

FIG. 7 is a further enlarged fragmentary front elevation of the lower portion of the blade of the sheet pickoff shown in FIGS. 1 to 6.

FIG. 8 is a further enlarged fragmentary view of the pickoff blade along line 8—8 of FIG. 7.

FIG. 9 is a further enlarged view of the pickoff blade along line 9—9 of FIG. 7.

DESCRIPTION OF THE PREFERRED EMBODIMENT

Figure 1:
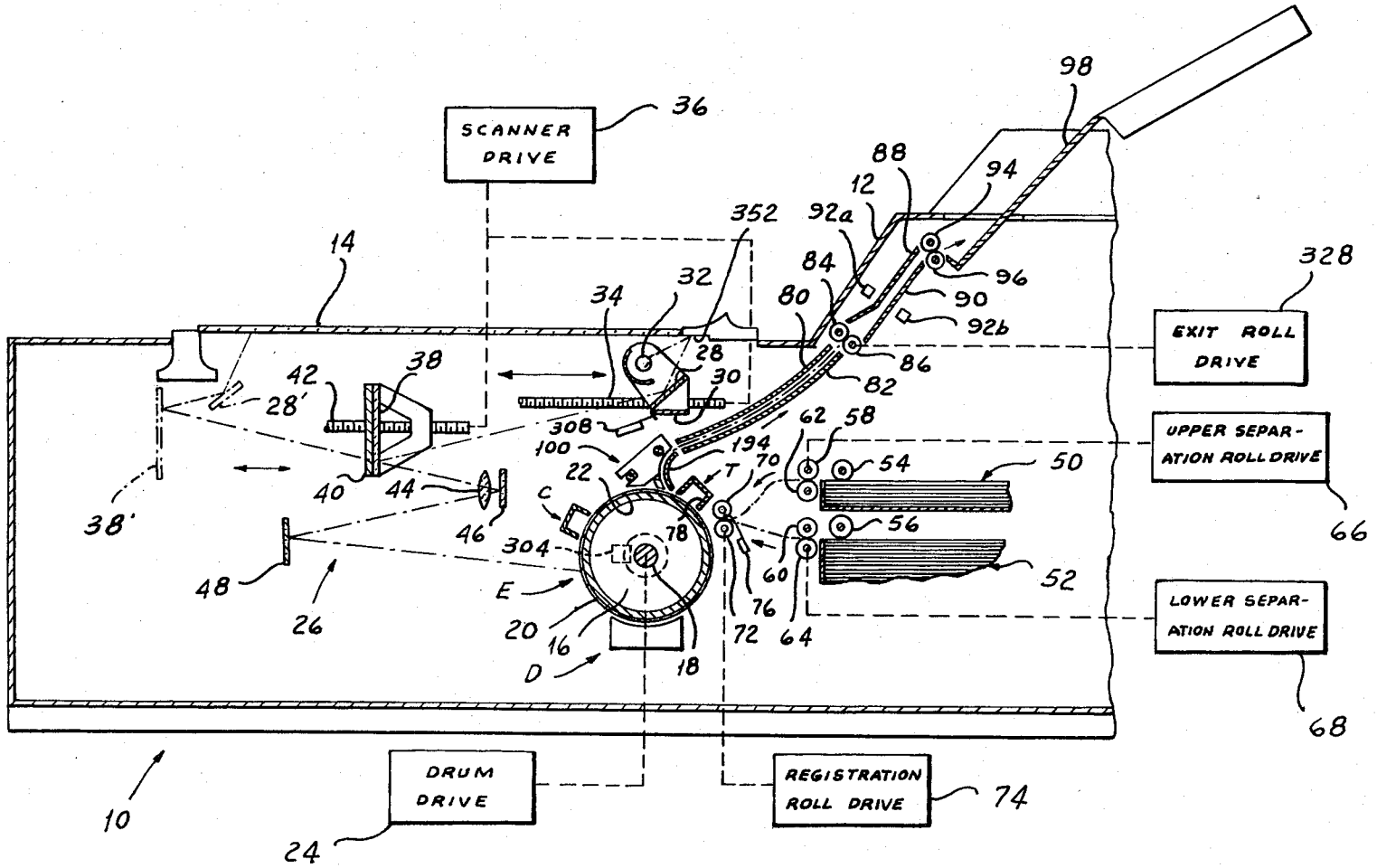
FIG. 1 is a fragmentary section of an electrophotographic copier incorporating my sheet pickoff.
Figure 2:
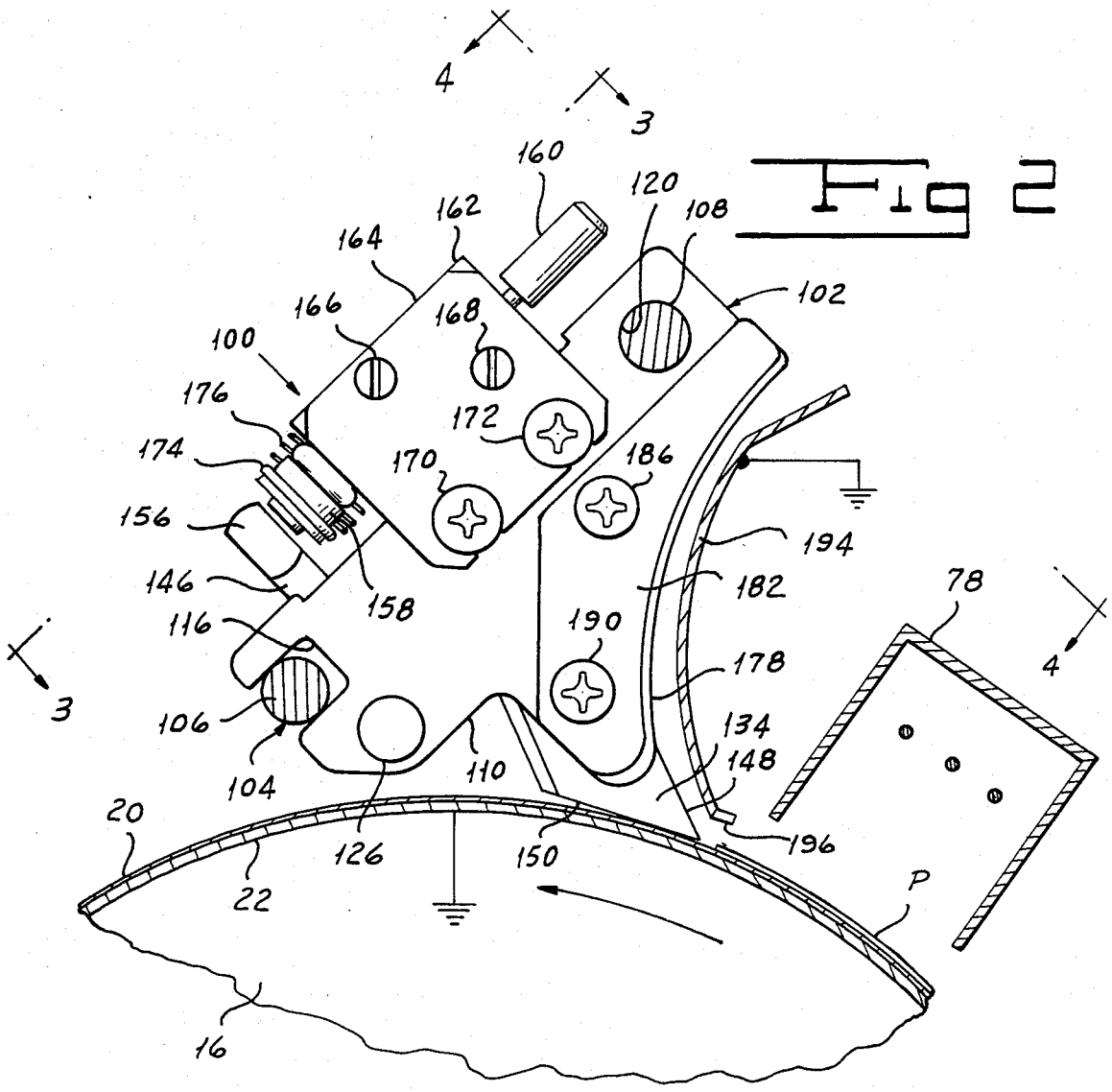
FIG. 2 is an enlarged fragmentary section of the sheet pickoff of the copier shown in FIG. 1.
Figure 6:
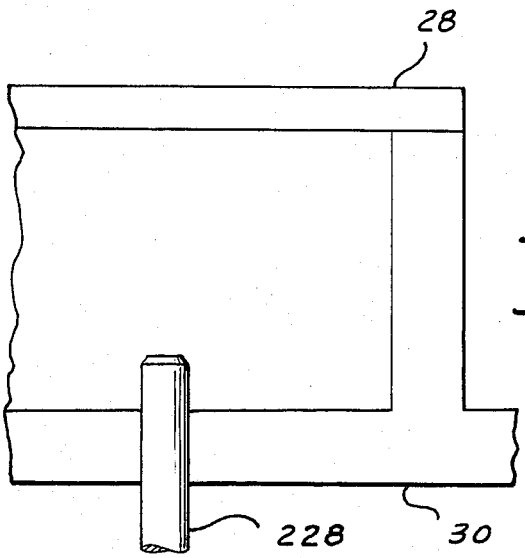
FIG. 6 is an enlarged fragmentary view of portions of the sheet pickoff and optical scanning systems of the copier shown in FIG. 1, along line 6—6 of FIG. 5.

Referring now to FIG. 1, a copier indicated generally by the reference numeral 10 incorporating my pickoff assembly includes a housing 12, the upper wall of which supports a transparent exposure platen 14. Originals (not shown) to be copied are placed on the platen 14 either manually or by means of a document feeder (not shown) of any suitable type known to the art. Copier 10 includes an electrophotographic imaging drum 16 supported on a shaft 18 for rotation therewith and having a photoconductive imaging surface 20 supported by a conductive substrate 22. A drive 24 of any suitable type known to the art controls rotation of the drum 16 in a manner to be described.

In a manner well known in the art, the imaging surface 20 is rotated first past a charging station C at which the surface receives a uniform electrostatic charge, then past an exposure station E at which the electrostatically charged surface 20 is exposed to an optical image of the original on the platen 14 to discharge the surface in a selective manner to form an electrostatic latent image, then past a developing station D at which a liquid developer containing charged toner particles (not shown) is applied to the latent-image-bearing surface to form a developed toner image thereon, and finally to a transfer station T at which the developed toner image is transferred from the drum surface 20 to a sheet of ordinary paper.

The corona in the charging station C may comprise two separate sections (not separately shown): a first, upstream AC corona section, which neutralizes any residual charge on the photoconductor 20, and a second, downstream DC corona section which provides the photoconductor with a uniform positive charge. Between the transfer station T and charging station C may be disposed a cleaning station, such as the ones shown in Tani et al U.S. Pat. No. 4,080,059 or Tani et al U.S. Pat. No. 4,032,229, at which the drum surface 20 moves successively past a wetted cleaning or scrubbing roller which cleans the surface of any remaining toner particles and a resilient contacting squeegee blade, which wipes the drum surface dry.

Figure 13:
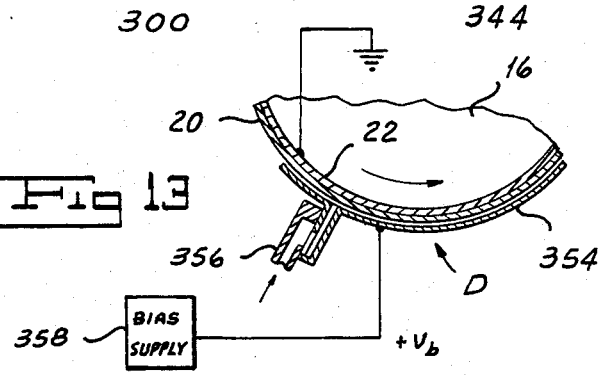
FIG. 13 is a partly schematic fragmentary section of the developing station of the copier shown in FIG. 1.

Referring now to FIG. 13, the developing station D includes a stationary development electrode 354 that is coaxial with the imaging drum 16 and spaced slightly from the photoconductive imaging surface 20 thereof. Assuming that the latent image formed on the photoconductor 20 is electrically positive, a liquid developer (not shown) containing negatively charged suspended toner particles is injected into the region between the development electrode 354 and the drum surface 20 through an inlet 356.

Assuming further that the original contains isolated areas of printed matter surrounded by relatively reflective background areas, the electrostatic latent image formed on the photoconductor 20 will consist of highly positive, substantially undischarged areas corresponding to the printed matter of the original, as well as areas corresponding to the background of the original that are substantially discharged and contain only a small residual positive charge. However, if the development electrode 354 were simply grounded, the negatively charged toner particles would deposit on the background image areas to some extent, resulting in copies having grey background areas. To prevent this undesirable result, the development electrode 354 is provided with a positive biasing potential $v_b$ relative to the drum substrate 22 from a bias supply 358. The biasing potential $v_b$ is greater than the residual positive potential of the background image areas, but substantially less than the potential of the undischarged areas of the photoconductor corresponding, for example, to printed matter on the original. As a result of this bias, toner particles are attracted only to the image areas corresponding to printed matter, and in the background areas of the image are preferentially attracted to the development electrode 354.

Eventually, the toner particles that are preferentially attracted to the development electrode 354 adjacent to the background image areas will create a layer of substantial negative charge on the electrode 354, effectively reducing the biasing potential as well as possibly physically interfering with the injection of fresh developer liquid. To keep these deposits on the electrode 354 to a minimum, the electrode is periodically cleaned of these deposits by electrically attracting the toner particles from the development electrode to non-image areas of the drum 20. In the embodiment shown, as will be described more fully below, this is accomplished by disabling the exposure lamp immediately upon the completion of the forward scanning stroke so as to produce a fully charged, unexposed non-image area on the photoconductor 20, between successive image areas. Since the photoconductor 20 when fully charged has a greater positive potential than the biasing potential $v_b$, toner particles will be electrically attracted from the development electrode 354 to the photoconductor 20 as a non-image area of the photoconductor passes through the developing station D.

In the embodiment shown, toner particles are electrically attracted from the development electrode 354 to the non-image areas of the photoconductor 20 by maintaining these areas fully charged, but unexposed. However, it will be apparent to those skilled in the art that other methods could be used, such as providing the electrode 354 with a reverse, or negative, biasing potential from supply 358 during the passage of non-image areas through the developing station D. If a reverse biasing potential is applied, it should be so timed as to leave a pre-image area on the photoconductor 20, free of toner deposits, for initial engagement by the pickoff blade.

In the optical scanning system of the copier 10, indicated generally by the reference numeral 26, a first scanner casting 30 is coupled to a lead screw 34 extending along the platen 14 and controlled by a drive mechanism 36 of any suitable type known to the art. Scanner casting 30 supports a transversely elongated exposure lamp 32 for directing light on the original placed on the platen 14 and a mirror 28 arranged to receive light reflected from the illuminated document portion. A second scanner casting 40 is coupled to a lead screw 42 also controlled by scanner drive 36. Scanner casting 40 supports a mirror 38. Mirror 28 directs light reflected from the original onto mirror 38, which redirects the light onto a focusing lens 44 having a mirror 46 associated therewith. Mirror 46 redirects the light back through the same lens 44 onto a stationary reflector 48, which directs the light onto the portion of imaging surface traversing the exposure station E.

Assuming a one-to-one reproduction ratio, a stationary original placed on the platen 14 is scanned by actuating drum drive 24 to rotate the drum 16 counterclockwise as viewed in FIG. 1 at a predetermined surface velocity, while simultaneously actuating scanner drive 36 to move reflector 28 at the same speed from an initial position shown in solid lines in FIG. 1 to an end-of-scan position 28' shown in dot-dash lines in the same figure. Simultaneously with the movement of drum 16 and reflector 28, scanner drive 36 actuates lead screw 42 to move reflector 38 in the same direction as reflector 28, but at half the speed, between an initial position shown in solid lines and an end-of-scan position 38' shown in dot-dash lines in FIG. 1 to maintain a constant optical path length. Any suitable means such as reduction gearing (not shown) between lead screws 34 and 42, a reduced pitch of lead screw 42, or a combination of both, may be used to ensure that reflector 38 is moved at one-half the speed of reflector 28. At the end of the forward scanning stroke, scanner drive 36 is actuated in the reverse direction so as to return scanning elements 28 and 38 to their initial positions in preparation for another scanning cycle.

Figure 10:
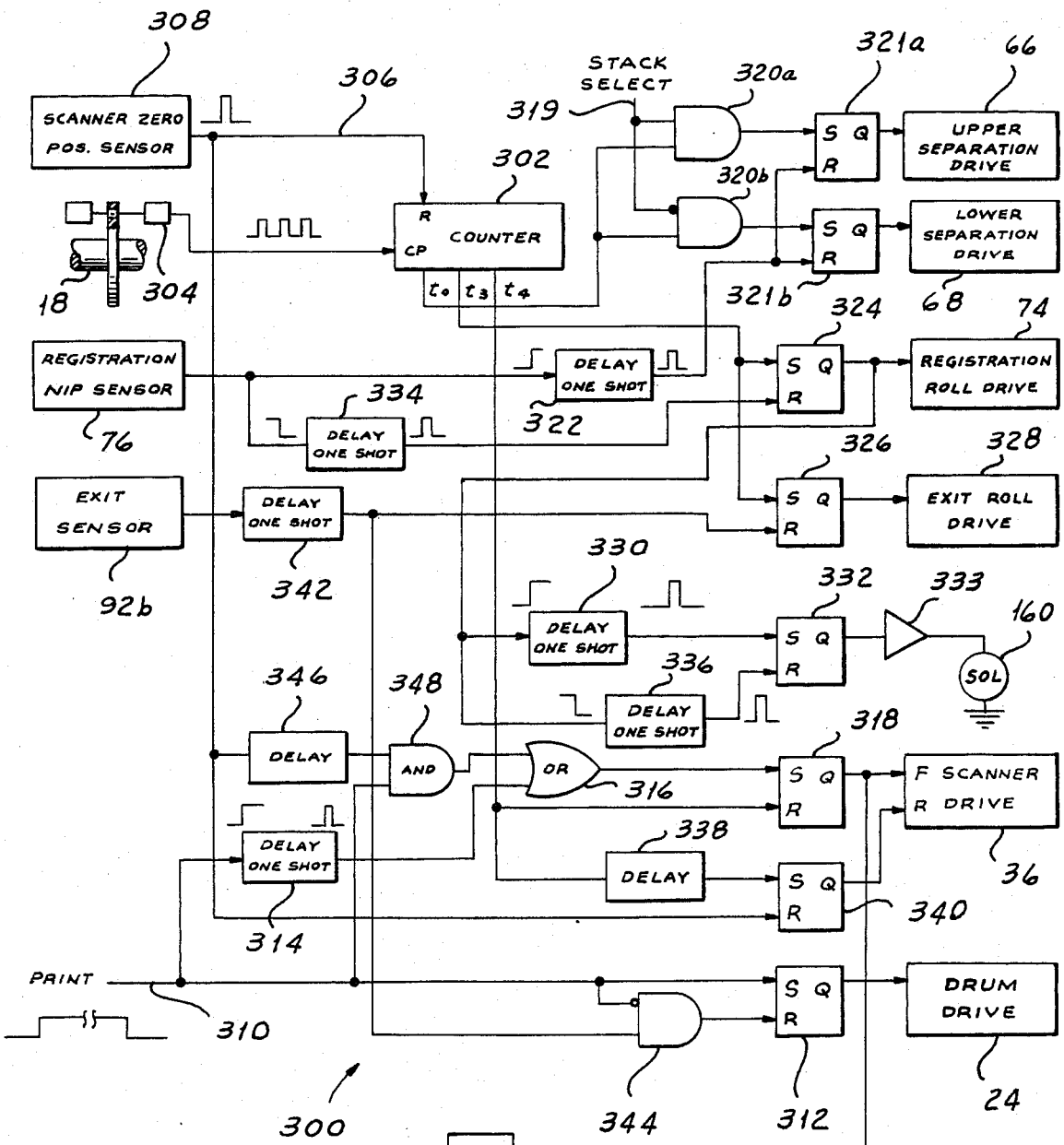
FIG. 10 is a schematic diagram of a control circuit for the copier shown in FIG. 1.

Referring now also to FIG. 10, a "zero position" sensor 308 provides a signal to the control circuit to be described upon the movement of scanner casting 30 to a predetermined position, slightly to the left of the position shown in solid lines in FIG. 1, at which mirror 28 begins to scan a document placed on the platen 14.

Copy sheets are supplied to the transfer station T for transfer of the developed toner image thereto either from an upper stack indicated generally by the reference numeral 50 or from a lower stack indicated generally by the reference numeral 52. Stack 50 may, for example, comprise $8\frac{1}{2}\times 14$ inch sheets that are fed lengthwise through the copier 10, while stack 52 may comprise $8\frac{1}{2}\times 11$ inch sheets that are fed crosswise through the copier. To advance a sheet from the upper stack 50, one or more sheet separator rollers 54 controlled by a drive mechanism 66 are actuated to advance the top sheet to the left, as viewed in FIG. 1, between a forwardly driven feed roller 58 and a reverse-driven retarding roller 62, also controlled by drive mechanism 66, to ensure the separation of the top sheet from any additional sheets urged from the stack by roller 54. After passing between rollers 58 and 62, the sheet enters the nip formed by opposing registration rollers 70 and 72, controlled by a separate drive 74. Registration rollers 70 and 72 hold the leading edge of the copy sheet at a registered position upstream of the transfer station T, and are energized at a proper time, in a manner to be described, to advance the registered sheet to the transfer station T in synchronism with the arrival of the developed image to be transferred to the sheet.

In a similar manner, to advance a sheet from the lower stack 52, one or more lower sheet separator rollers 56 engaging the top sheet of the lower stack 52 are actuated to advance the top sheet to the left, as viewed in FIG. 1, between a forwardly driven feed roller 60 and a reverse-driven lower retarding roller 64. A separate drive mechanism 68 controls rollers 56, 60 and 64. After passing between rollers 60 and 64, the sheet enters the nip formed by registration rollers 70 and 72. A sensor 76 of any suitable type known to the art, such as a mechanical feeler, detects the presence of a sheet in the nip formed by registration rollers 70 and 72.

In the transfer station T, a transfer corona 78 extending parallel to the drum axis supplies the sheet fed from stack 50 or 52 with an electrostatic charge opposite in polarity to that of the developed toner image to assist in the transfer of the image from the drum surface 20. Immediately upon emerging from the transfer corona 78, the leading edge of the sheet is engaged by the blade of the pickoff assembly, indicated generally by the reference numeral 100, that is the subject matter of the present invention. After it is separated from the drum surface, the upper, non-image-bearing face of the sheet is electrostatically tacked to an arcuate grounded conductive guide 194. Guide 194 directs the emerging copy sheet between a first pair of upper and lower exit guides 80 and 82 into the nip formed by opposing upper and lower exit rollers 84 and 86. Exit rollers 84 and 86 continue to advance the sheet between a further pair of upper and lower exit guides 88 and 90 into the nip formed by a second pair of exit rollers 94 and 96. A photosensor **92*b* disposed along the exit path between rollers 86 and 96 cooperates with a light source 92*a* located on the other side of the same path to detect the presence of an emerging sheet of paper. Copy sheets emerging from exit rollers 94 and 96 are collected, image side up, in a receiving tray 98**.

Referring now particularly to FIGS. 2 to 5 and 12, the pickoff assembly 100 comprises a frame or carriage, indicated generally by the reference numeral 102, mounted on a stationary frame indicated generally by the reference numeral 104. Stationary frame 104 includes a pair of parallel support rods 106 and 108 extending transversely of the copier 10, rod 106 being located below and to the left of rod 108 as viewed from the front of the machine 10 in FIG. 2. The traversing carriage 102 comprises a body 114 formed with a bore 120 which slidably receives rod 108. A pair of spaced lugs 110 and 112 on the end of body 114 remote from rod 108 are formed with slots 116 and 118 which slidably receive rod 106.

A bell crank indicated generally by the reference numeral 122 is integrally formed with a central sleeve 124, which receives a pin 126 supported in respective bores 128 and 130 formed in lugs 110 and 112. The lower arm 132 of the bell crank 122 supports the pickoff blade 134. Spaced locating pins 136 and 138 received respectively in a hole 140 and in a slot 142 in blade 134 position the blade on the arm with the correct orientation. After the blade 134 has been positioned on the arm it is secured to the lower crank arm 132 by any suitable means such as a screw 144. Preferably, to minimize the generation of normal reaction forces tending to urge blade 134 into the drum surface 20, the axis of pivot pin 126 should lie in or near the plane of tangency of blade 134 with surface 20.

Referring now also to FIGS. 7 to 9, pickoff blade 134 is formed with a leading edge 148, which contacts the separated lower surface of the copy sheet to guide a sheet P away from the drum 16, and with a lower edge 150 urged into contact with the photoconductor surface 20 by gravity. Preferably, the blade pivot axis is so located that the tip of blade 134 extends beyond the point of tangency of lower blade edge 150 with drum surface 20 by an "overhang" d of about 0.046 inch. Providing the tip of the pickoff blade 134 with an overhang in this manner materially lessens the risk that the tip of the blade will gouge the drum surface 20. Preferably the blade 134 is formed with bevelled surfaces 152 and 154 along the leading edge 148 to minimize the extent of contact of the blade 134 with the underside of the copy sheet P, thereby to minimize any smearing of the transferred toner image. The lower blade edge 150 is preferably rounded along its sides to minimize any damage to the drum surface 20 as the blade 134 is shifted laterally in the manner to be described.

Since the lower edge 150 of the blade 134 is straight so that it makes only line contact with the drum surface in the direction of the drum axis, the blade can be used with drums 20 of various diameters. Preferably, the leading edge 148 forms an angle of about 45° with the lower edge 150, while bevelled surfaces 152 and 154 form a 90° angle with each other. A larger angle between surfaces 152 and 154, such as 105°, will result in greater durability, but will also tend to increase the accumulation of toner on the leading edge of the blade.

Preferably, blade 134 is formed from a sheet of hardened steel of about 0.5 millimeter thickness, with a chromium coating. The chromium coating not only increases the durability of the blade 134, but also provides the blade with an antiwetting property whereby it resists contamination with wet toner material.

If desired, the blade 134 may be constructed of a conductive plastic instead of a metal to reduce drum wear. One type of conductive plastic, available from LNP Corp. under the designation RC1006, has been used to strip 12,000 copies without noticeable wear. If a conductive material, whether metal or plastic, is used to form the blade 134, the blade should be grounded—that is, at the same potential as substrate 22. Otherwise, the blade 134 will tend to accumulate an electrostatic charge resulting from the separation of the sheet P from the drum 16.

It is also possible to form the blade 134 of a nonconductive plastic or other material. In such a case, however, the material should be so situated in the triboelectric series relative to the drum photoconductor 20 that the blade 134 becomes negatively charged (or positively charged, if a positive toner is used) through frictional contact with the drum 16. A suitable material from an electrical standpoint is the synthetic polyester sold under the trademark MYLAR. The negative charge acquired by a blade 134 constructed of such a conductive plastic repels like-charged toner deposits picked up from the drum surface 20.

Referring particularly to FIGS. 2 to 5 and 12, an upper arm 146 of bell crank 122 is formed with an extension 156. Extension 156 is adjacent to the armature 158 of a solenoid, indicated generally by the reference numeral 160, carried by a C-shaped support 162. Screws 166 and 168 secure support 162 to a bracket 164 which is secured to the outboard surface of front carriage wall 110 by screws 170 and 172. Normally, with the solenoid 160 de-energized, a compression spring 176 disposed between support 162 and a retaining ring 174 of solenoid armature 158 urges the armature downwardly against upper arm extension 156 to lift the lower arm 132 and pickoff blade 134 from the drum surface 20. Actuation of solenoid 160 retracts armature 158 from upper arm extension 156, against the action of spring 176, to the position shown in FIG. 2. This allows a tension spring 177 (FIGS. 3 and 12) disposed between solenoid 160 and extension 156 to urge the pickoff blade 134 downwardly against the drum surface 20 with a fixed force of approximately 5 to 10 grams. By virtue of this arrangement, the pickoff blade is lightly urged against the drum surface 20 by spring 177 and is not forceably driven against the surface by the solenoid 160. Spring 176 serves only to bias the blade 134 to a quiescent position spaced from the drum surface 20, while actuation of solenoid 160 merely serves to defeat this biasing action of the spring 176. The retraction force of spring 176 must of course be sufficient to overcome the force of spring 177 if spring 176 is to perform its lifting function properly. Preferably, the liftoff of the blade 134 from the photoconductive surface 20 is limited to about 0.010 to 0.020 inch to reduce the delay between actuation of solenoid 160 and engagement of blade 134 with surface 20. Other types of springs such as compression springs or leaf springs may be used instead of tension spring 177.

Lugs 110 and 112 of carriage 102 carry respective guides 178 and 180, which direct the separated copy sheet P along an arcuate exit path following its initial separation from the drum surface 20 by blade 134. Preferably, guides 178 and 180 are formed of the polyester sold under the trademark MYLAR, and are relatively thin with sharp leading edges to minimize the accumulation of toner deposits. A retaining plate 182 mounted on lug 110 by means of screws 186 and 190 secures guide 178 to lug 110, while a similar retaining plate 184 mounted on lug 112 by corresponding screws 192 secures guide 180 to lug 112. As noted above, an arcuate grounded conductive guide 194, shown in FIGS. 2 and 5, extends transversely of the imaging drum 16 at a slight spacing from the photoconductive surface 20 and from the pickoff blade 134 and guides 178 and 180. As the leading edge of the separated copy sheet P moves along the leading edge 148 of blade 134, the upper, non-image-bearing side of the sheet is electrostatically attracted to the outer, convex surface of the guide 194, which directs the copy sheet into the exit path of the copier 10 leading to exit rollers 84 and 86.

Guide 194 serves as the primary support surface for the separated portion of the copy sheet P. The leading edge 148 of the pickoff blade supports the undersurface of the sheet P only during the initial phase following pickoff, while guides 178 and 180 serve only as backup supports, should the copy sheet fail to adhere electrostatically to the guide 194. In this manner, any smearing of the transferred toner image from frictional contact with the image-bearing surface of the sheet P is minimized. Preferably, guide 194 is formed with a bent-back portion 196 at its lower end to minimize any possibility that the leading edge of the separated copy sheet P may become caught at that end of the guide.

Figures 4, 12:
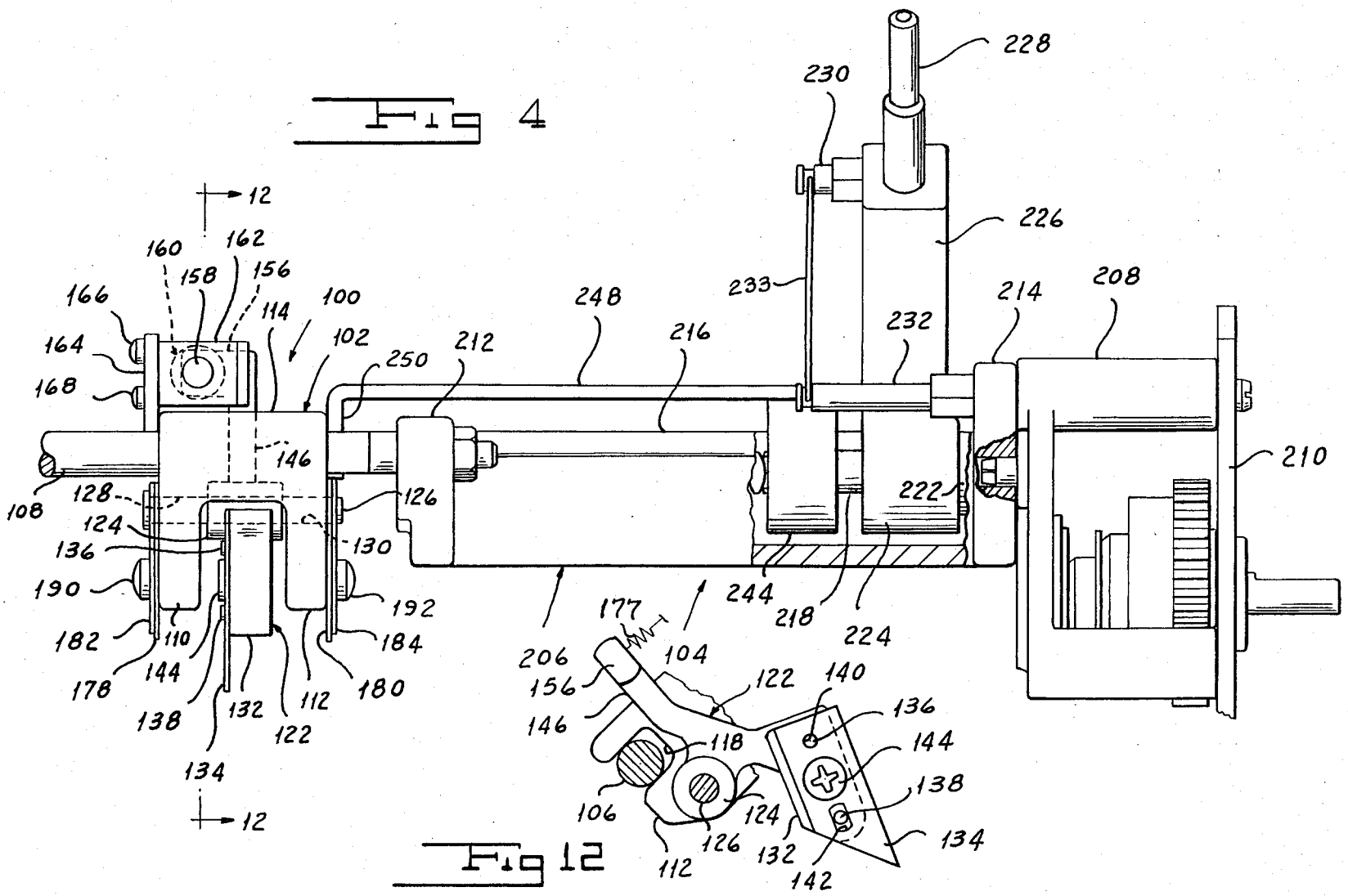
FIG. 4 is an enlarged fragmentary view of the sheet pickoff of the copier shown in FIG. 1, along line 4—4 of FIG. 2.
FIG. 12 is an enlarged fragmentary section of the blade supporting portion of the sheet pickoff, along line 12—12 of FIG. 4.

Referring now particularly to FIGS. 3 and 4, rods 106 and 108 of the stationary support assembly 104 extend parallel to the axis of copier drum 16 between a front support 202, mounted on the inboard surface of a front copier wall 204, and the front bearing plate 212 of a lead screw support member indicated generally by the reference numeral 206. The rear bearing plate 214 of lead screw support 206 is secured to a gear housing 208 mounted on the inboard surface of a rear copier wall 210. Support rods 106 and 108, together with supports 202, 206 and 208, constitute a rigid stationary support assembly 104, extending between copier walls 204 and 210, relative to which the pickoff carriage 102 is transversely reciprocated.

Lead screw support 206 comprises an elongated hollow semicylindrical portion 216 within which I position a double-helix lead screw 218. Respective bearings 220 and 222 carried by the front and rear plates 212 and 214 of lead screw support 206 rotatably support lead screw 218.

Figures 1, 11:
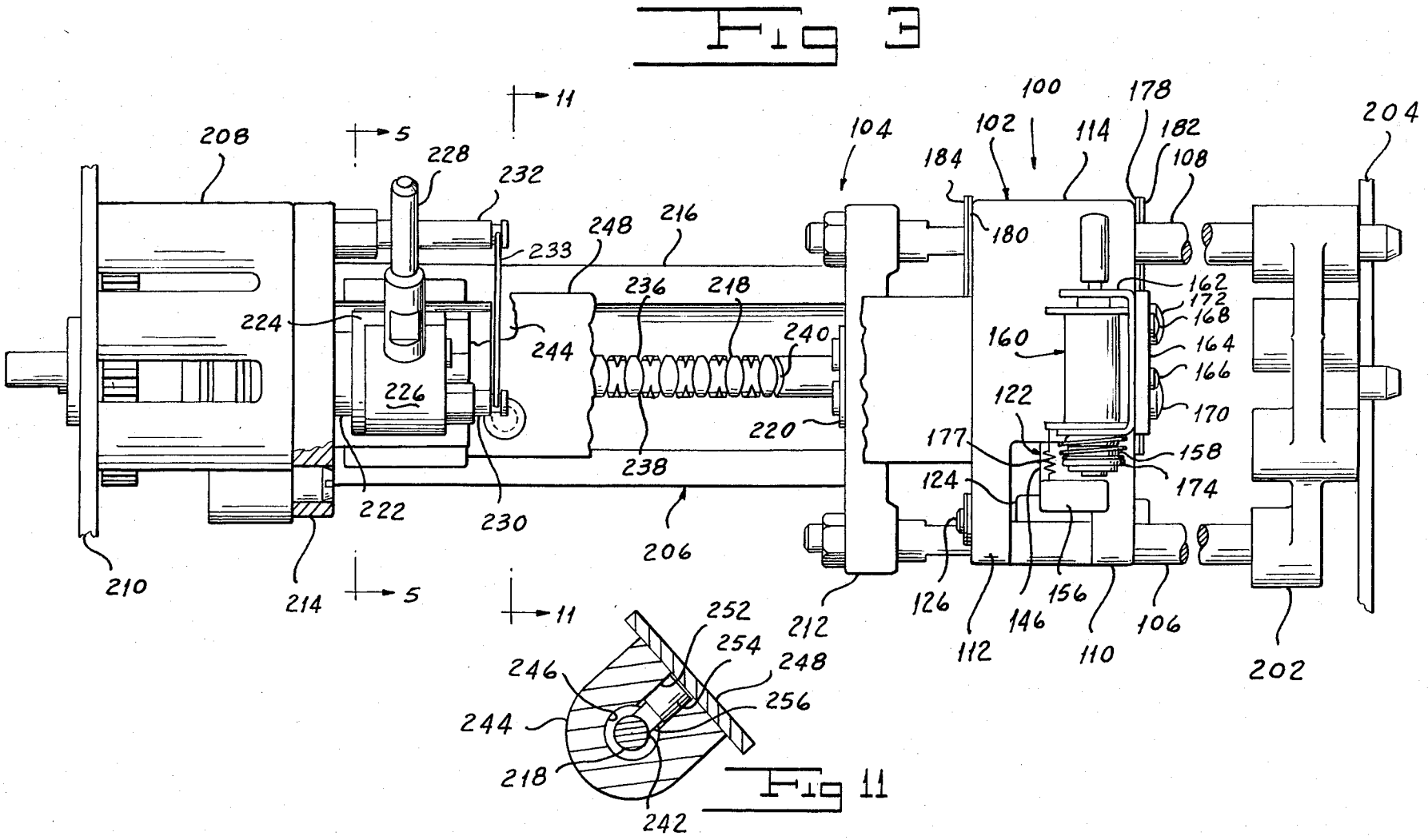
FIG. 11 is an enlarged section of a portion of the traversing mechanism of the sheet pickoff, along line 11—11 of FIG. 3.

Referring now also to FIG. 11, lead screw 218 is formed with intersecting right-hand and left-hand threads 236 and 238. Respective end portions 240 and 242 join the right-hand thread 236 and left-hand thread 238 near the front and rear ends of the screw 218, so that the screw threads form a single endless path extending around the periphery of the screw 218 while reciprocating in alternate directions along its length. A follower block 244 formed with a bore 246 for receiving the screw 218 is carried by a spacer bracket 248, the front portion 250 of which is secured to the rear wall 112 of the traversing frame 102.

Follower block 244 is formed with a second bore 252 intersecting the lead screw bore 246 from the direction of the spacer bracket 248. Bore 252 loosely receives a generally cylindrical plug 254 having a rider 256 adapted to extend into the threaded rear end portion 242 of lead screw 218. Rider 256 is of sufficient circumferential extent that it can only pass from the right-hand thread 236 to the left-hand thread 238, or vice versa, at the end portions 240 and 242 of the screw threads. By virtue of this structure, unidirectional rotation of the lead screw 218 produces a traversing motion of the follower block 244, and hence the spacer bracket 248 and pickoff frame 102, as the rider 256 unidirectionally traverses the endless path defined by the screw threads 236 and 238.

A one-way clutch 224 of any suitable type known to the art, carried by lead screw 218 at its rear end, couples the screw to an upwardly extending lever arm 226 carrying a pin 228.

Figure 5:
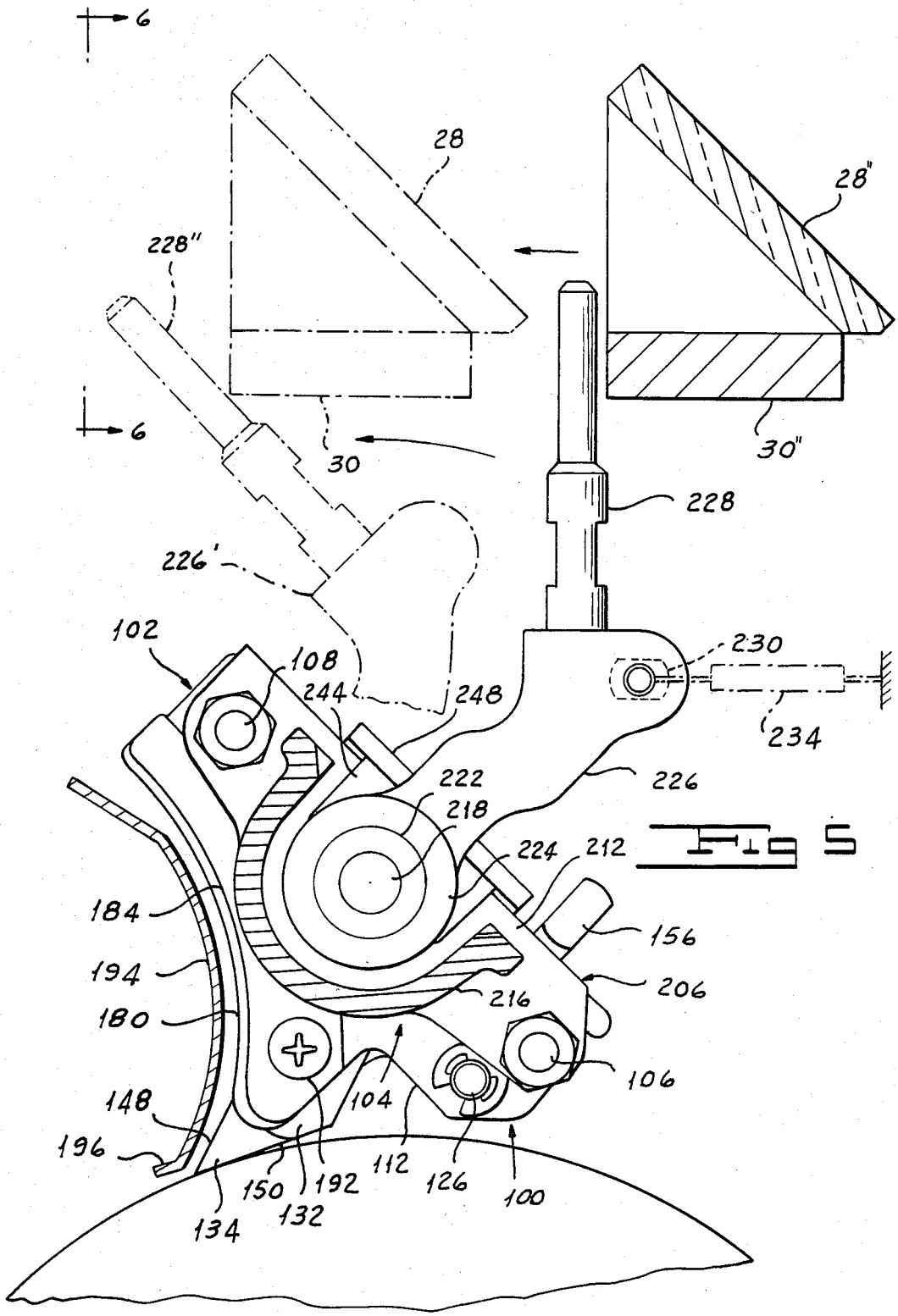
FIG. 5 is an enlarged section of the sheet pickoff of the copier shown in FIG. 1, along line 5—5 of FIG. 3.

Referring now to FIGS. 3 to 5, a flexible inextensible line 233 connects a post 230 on arm 226 to a fixed post 232 on rear bearing plate 214 of support 206. A tension spring 234 carried by post 230 and by a fixed frame portion of the copier 10 urges arm 226 to a limit position, determined by line 233, at which pin 228 extends upwardly into the path of casting 30 as shown in full lines in FIG. 5. Thus, when on the return scanning stroke, scanner casting 30 moves from the intermediate position 30″ shown in solid lines in FIG. 5 to the initial position shown in dot-dash lines in the same figure, it deflects lever arm extension 228 toward the exit end of the copier 10, causing lever arm 226 to pivot about the axis of lead screw 218 to the deflected position 226′. Upon subsequent movement of scanner casting 30 in the direction of position 30″ on a forward scanning stroke, lever arm 226 returns to its quiescent position under the influence of biasing spring 234.

It will be apparent from the foregoing description that lever arm 226 undergoes a reciprocating motion between the two positions shown in FIG. 5 at the beginning of each scanning cycle. Clutch 224 uncouples lead screw 218 from lever arm 226 upon its return stroke to the position shown in solid lines in FIG. 5 to produce an incremental unidirectional rotation of lead screw 218. This rotation of lead screw 218 in turn causes the pickoff assembly 100 to reciprocate transversely of the photoconductive imaging drum 16 in the manner described above.

Preferably the incremental advance of the pickoff blade 134 across the photoconductive surface at the beginning of each scanning cycle is about 0.5 millimeter, or 0.02 inch, to prevent the blade 134 from contacting any one circumferential strip of the drum surface long enough to discharge the surface and produce image voids of the type mentioned above. The extent of blade traverse, determined by the separation between end portions 240 and 242 of the lead screw thread, is preferably at least about 2 inches to distribute the blade wear over a reasonably large portion of the surface 20 of drum 16. A traverse extent of this magnitude also allows a circumferential strip of the imaging surface 20 contacted by the blade 134 to return to the potential of adjacent drum areas after becoming partially discharged by contact with the blade. About 50 copy cycles is sufficient to permit this equalization of surface potential.

FIG. 10 shows a suitable control circuit, indicated generally by the reference numeral 300, for the copier 10. While the circuit 300 employs special-purpose digital logic elements, it will be apparent to those skilled in the art that the same control functions could be accomplished using a suitably programmed general-purpose digital computer, such as an Intel 8048 microcomputer. The basic timing pulses of the control circuit 300 are derived from a counter 302, which is indexed by a pulse train from a position encoder 304, also shown in FIG. 1, responsive to the rotation of drum shaft 18. Counter 302 is reset at the beginning of each copy cycle in response to a pulse on line 306 from the scanner zero position sensor 308.

A copy sequence comprising one or more copy cycles is initiated in response to a positive-going level transition on a "print" line 310, generated in any suitable manner known to the art, such as by closure of a manually actuated print switch (not shown). The signal on print line 310 is applied to the S, or set, input of an RS flip-flop 312, the Q output of which then actuates drum drive 24. Upon the lapse of a predetermined time delay following the positive-going level transition on line 310, a delay one-shot 314 supplies a pulse to an OR circuit 316, which in turn supplies a signal to the S input of a flip-flop 318. Flip-flop 318 actuates the scanner drive 36 to initiate movement of scanning elements 28 and 38 to the left as viewed in FIG. 1. In addition, flip-flop 318 actuates a driver 350 to energize exposure lamp 32.

As exposure lamp 32 and mirrors 28 and 38 move to the left from their initial positions shown in solid lines in FIG. 1, they first scan a highly reflective surface portion 352, located at the right end of the exposure platen 14, before reaching a position at which they scan a document (not shown) placed upon the platen. As a result, the drum photoconductor 20 has a fully exposed, and thus discharged, preimage area in advance of the area containing the electrostatic latent image of the original. Since this pre-image area is always less positively charged than the development electrode 354, negatively charged toner particles will be preferentially attracted to the electrode, keeping the pre-image area free of toner deposits. By timing the engagement of the pickoff blade 134 with the drum surface 20 so as to begin with this pre-image area, I avoid the pickup of residual toner particles that would occur, for example, if the pickoff blade were to engage a non-image area onto which toner particles have been deposited from the development electrode 354.

Shortly after moving from its initial position shown in solid lines in FIG. 1 and upon completing the scan of the pre-image area, scanner casting 30 trips the scanner zero position sensor 308 to cause the sensor to supply a reset signal on line 306 to counter 302. Thereafter, counter 302 counts in response to the pulse train generated by the position encoder 304 synchronously with the rotation of imaging drum 16. Upon reaching a predetermined count $t_0$, counter 302 supplies signals to inputs of gates 320*a* and 320*b*. A "stack select" line 319 is coupled to an enabling input of gate 320*a* and to an inhibit input of gate 320*b*, so that gate 320*a* is enabled whenever line 319 carries a "1" logic signal while gate 320*b* is enabled whenever gate 319 carries a "0" logic signal. Gate 320*a* controls upper separation drive 66 through flip-flop 321*a*, while gate 320*b* controls lower separation drive 68 through flip-flop 321*b*. Thus, when counter 302 reaches a count of $t_0$, either upper separation drive 66 or lower separation drive 68 is actuated, depending on the logic level of "stack select" line 319.

Assuming for the purposes of this example that line 319 is at a "1" logic level so as to enable gate 320*a*, upper separation drive 66 actuates rollers 54 and 58 to initiate the feeding of a sheet from the upper stack 50. Upper separation drive 66 also actuates retarding roller 62, but in a clockwise direction as viewed in FIG. 1 to oppose the feeding of more than one sheet between the nip formed by rollers 58 and 62. Upper separation drive 66 remains actuated until the leading edge of the sheet trips registration nip sensor 76. Upon the lapse of a predetermined time delay following the appearance of an output from sensor 76, sufficient to permit buckling of the sheet in the nip formed by rollers 70 and 72, a delay one-shot 322 responsive to sensor 76 supplies a pulse to the R, or reset, inputs of flip-flops 321*a* and 321*b* to disable the previously actuated separation drive, in this case upper drive 66.

Upon subsequently reaching a predetermined count $t_3$, counter 302 supplies a signal to the S input of a flip-flop 324 controlling the registration roll drive 74. Registration roll drive 74 actuates rollers 70 and 72 to initiate the feeding of the previously registered sheet so that the arrival of the leading sheet edge in the transfer station T coincides with the arrival of the leading edge of the developed toner image. After a predetermined time period has elapsed following the setting of flip-flop 324, sufficient to permit the leading sheet edge to approach within 1 to 2 inches of blade 134, a delay one-shot 330 responsive to flip-flop 324 supplies a pulse to the S input of a flip-flop 332. Flip-flop 332 thereupon supplies a signal to a drive 333, which actuates pickoff solenoid 160 to permit the movement of blade 134 into engagement with the photoconductive surface 20 to intercept the leading sheet edge. As noted above, this initial pickoff engagement is timed to occur upon a fully discharged pre-image area to avoid any pickup of heavy toner deposits.

To ensure separation from the drum surface of any additional sheets tacked to the first sheet fed from the stack 50, solenoid 160 remains actuated until about the leading 4 inches of the first sheet has been separated from the drum 16. Thereafter, a delay one-shot 336 also responsive to flip-flop 324 supplies a signal to the reset input of solenoid flip-flop 332 to disable pickoff solenoid 160. By engaging pickoff blade 134 with the drum surface 20 in this intermittent manner, the duration of contact with the drum surface, and hence the degree of wear of that surface, is minimized.

Upon reaching a count of $t_3$, counter 302 also supplies a signal to the S input of a flip-flop 326 controlling exit roll drive 328 to actuate exit rollers 84, 86, 94 and 96. Upon subsequently reaching a predetermined count $t_4$, counter 302 supplies a signal to the reset input of the forward scanner flip-flop 318 to terminate the forward actuating signal to scanner drive 36 as well as to terminate the actuation of exposure lamp 32 through driver 350. Upon the passage of a predetermined time delay following $t_4$, a delay circuit 338 responsive to counter 302 supplies a signal to the S input of a flip-flop 340 controlling the reverse input to scanner drive 36. Scanner drive 36 thereafter rotates lead screws 34 and 42 in such a direction as to return scanning elements 28 and 38 to their original positions, shown in solid lines in FIG. 1. Shortly thereafter, the trailing edge of the sheet fed from the stack 50 should have cleared the registration nip sensor 76. When this happens, a delay one-shot 334 responsive to the negative-going level transition in the output from sensor 76 supplies a pulse to the reset input of registration roll flip-flop 324 to deactuate registration roll drive 74.

At this point, the sheet from stack 50 is entrained in exit rollers 84, 86, 94 and 96, which were actuated simultaneously with the registration rollers 70 and 72. When the trailing edge of the sheet traverses the exit sensor 92*b* located intermediate rollers 86 and 96, the output from sensor 92*b* drops to zero. Upon the lapse of a predetermined time delay following this transition, sufficient to permit the trailing sheet edge to clear rollers 94 and 96 and reach the tray 98, a delay one-shot 342 responsive to sensor 92*b* supplies a signal to the reset input of exit roller flip-flop 326 to disable the exit roller drive 328.

As noted above, scanner casting 30 strikes lever arm extension 228 on its return to impart unidirectional rotation to lead screw 218 to move pickoff carriage 102 in an incremental manner transversely of the direction of movement of drum surface 20. When scanner casting 30 returns to the position at which it previously actuated zero position sensor 308, it reactuates the sensor 308 to cause the sensor to provide a signal on line 306. Line 306 in turn supplies a signal to the reset input of reverse scanner flip-flop 340 to discontinue the reverse input to scanner drive 36. Scanner elements 28 and 38 then coast to their initial positions shown in solid lines in FIG. 1. Shortly thereafter, a delay circuit 346 responsive to line 306 supplies a signal to one input of an AND gate 348, the other input of which is derived from print line 310. AND gate 348 in turn supplies a signal to the set input of forward scanner flip-flop 318 through OR gate 316 to reactuate scanner drive 36 in the forward direction in preparation for another scanning cycle.

The sequence of operation described above continues until the print signal is removed from line 310 and the exit sensor **92*b* senses the passage of the trailing edge of the last sheet. When both of these events occur, delay one-shot 342 supplies a signal to one input of a gate 344, the inhibit input of which had previously been actuated by the print signal on line 310. Gate 344 thereupon supplies a signal to the reset input of drum flip-flop 312 to disable the drum drive 24**.

It will be seen that I have accomplished the objects of my invention. My sheet pickoff allows the transfer of a developed image to the entire area of a copy sheet and, at the same time, is reliable. My sheet pickoff does not result in excessive wear of an imaging surface, nor does it leave toner deposits on the image sides of copy sheets or permit the buildup of triboelectric charges on the drum. My sheet pickoff is able to operate a relatively long period of time without requiring adjustment or replacement of parts, and is usable with imaging drums of various diameters. Finally, my sheet pickoff does not accumulate excessive toner deposits from an imaging surface.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In an electrophotographic copier having a photoconductor, means including a movable scanning element for forming a latent electrostatic image of a document on said photoconductor, means for developing said latent image to form a developed image, means for supplying a carrier sheet to said photoconductor, and means for moving said photoconductor past said image-forming means, said developing means and said sheet-supplying means, apparatus for separating said carrier sheet from said photoconductor including in combination a pickoff element, means for positioning said pickoff element in engagement with said photoconductor, and means responsive to said scanning element for shifting said pickoff element transversely of said photoconductor with reference to the direction of movement thereof.

2. Apparatus as in claim 1 in which said scanning element is a reciprocating scanning element, said shifting means comprising means responsive to movement of said scanning element to a predetermined position for shifting said pickoff element.

3. Apparatus as in claim 1 in which said shifting means comprises a reciprocating member coupled to said pickoff element, a threaded member engaging said reciprocating member, a sensing element positioned in the path of movement of said scanning element, and a one-way clutch coupling said sensing element to said threaded member.

4. In an electrophotographic copier having a photoconductor, means for forming a developed image on said photoconductor, and means for supplying a carrier sheet adjacent said photoconductor for transfer of said developed image thereto, apparatus for separating said carrier sheet from said photoconductor following said transfer of said image including in combination a pickoff element, means for positioning said pickoff element in engagement with said photoconductor, a reciprocating member coupled to said pickoff element, a threaded member engaging said reciprocating member and means for rotating said threaded member to reciprocate said pickoff element.

5. Apparatus as in claim 4 in which said threaded member is a double-helix lead screw.

6. Apparatus as in claim 4 in which said photoconductor is adapted to move past said developed-image-forming means and said sheet-supplying means, said threaded member being supported for rotation around an axis extending transversely of said photoconductor with reference to the direction of movement thereof.

7. Apparatus as in claim 4 in which said rotating means comprises a mover and a one-way clutch coupling said mover to said threaded member.

8. In an electrophotographic copier having a photoconductor, means for forming a latent electrostatic image on an image portion of said photoconductor, means including a developing electrode for applying a liquid developer containing toner material to said photoconductor to develop said latent image, means for supplying a carrier sheet adjacent said photoconductor for transfer of said developed image thereto, and means for moving said photoconductor past said latent-image-forming means, said developing means and said sheet-supplying means, the improvement comprising means for electrostatically attracting toner material from said developing electrode onto a non-image portion of said photoconductor, a pickoff element arranged to engage said image portion of said photoconductor adjacent said sheet, and means for retracting said pickoff element from said photoconductor concurrently with its relative movement past said non-image portion.

* * * * *